US006595434B1

(12) United States Patent
Seeger

(10) Patent No.: US 6,595,434 B1
(45) Date of Patent: Jul. 22, 2003

(54) RAIL BOUNDED TRANSPORT SYSTEM

(75) Inventor: Gerhard Seeger, Lesjofors (SE)

(73) Assignee: Hen-See Teknik AB, Karlskoga (SE)

( * ) Notice: Subject to any disclaimer, the term of this patent is extended or adjusted under 35 U.S.C. 154(b) by 27 days.

(21) Appl. No.: 09/582,209

(22) PCT Filed: Jan. 15, 1999

(86) PCT No.: PCT/SE99/00045

§ 371 (c)(1),
(2), (4) Date: Sep. 14, 2000

(87) PCT Pub. No.: WO99/39053

PCT Pub. Date: Aug. 5, 1999

(30) Foreign Application Priority Data

Jan. 19, 1998 (SE) ..... 9800106

(51) Int. Cl.[7] ..... E01B 13/00
(52) U.S. Cl. ..... 238/338; 238/349; 238/351
(58) Field of Search ..... 238/2, 3, 5, 7, 238/9, 264, 265, 269, 270, 273, 287, 290, 291, 294, 297, 298, 299, 303, 308, 310, 338, 342, 343, 345, 349, 350, 351, 366, 371, 372

(56) References Cited

U.S. PATENT DOCUMENTS 556,348 A * 3/1896 Harris ..... 238/298
1,834,256 A * 12/1931 Ruping ..... 238/298
2,132,572 A * 10/1938 Maney ..... 238/349
3,519,205 A * 7/1970 Monclin et al. ..... 238/297
3,732,791 A 5/1973 Hohwiller et el.
4,311,273 A 1/1982 Marsh
4,319,416 A 3/1982 Scheuchzer et al.
4,400,897 A 8/1983 Scheuchzer et al.
4,695,017 A 9/1987 Ringer et al.
4,802,623 A 2/1989 Fasterding et al.
4,927,078 A 5/1990 Vanotti
5,042,717 A 8/1991 Vanotti
5,096,119 A 3/1992 Schultheiss et al.
5,123,596 A * 6/1992 Fisher et al. ..... 238/342

FOREIGN PATENT DOCUMENTS

DE 4006659 9/1990

* cited by examiner

*Primary Examiner*—Mark T. Le
(74) *Attorney, Agent, or Firm*—Dennison, Schultz & Dougherty

(57) ABSTRACT

Track-bound transport systems have existed for a long time. The drawback with them is that they can only withstand low load and are vulnerable in varying weather conditions. The purpose of the invention is to considerably increase the load they are capable of supporting and to reduce dependence on changes in weather.

1 Claim, 3 Drawing Sheets

RAIL BOUNDED TRANSPORT SYSTEM

This application is a 371 of PCT/SE900451 Jan. 15, 1999.

The present invention relates to a track-bound transport system. Such systems have been known for a long and comprise foundations such as bridges, a track bed and sleepers with attachment means for rails. Such transport systems may be located in various places with varying weather conditions. The system also comprises rolling units driven along the system. Hitherto it has been difficult to construct such systems to carry loads of more than 20 ton. Furthermore, problems arise at varying weather conditions, such as displacement of the rails upon thawing of frozen soil.

The object of the present invention is to provide a rail attachment for a track-bound transport system.

Two rails are placed on a sleeper with two flat sole plates for each rail, which are bolted onto the sleeper. Prior to application on the sleeper the sole plate is provided with two downwardly directed spikes, with corresponding holes in the sleeper to fit them. A bolt is inserted into these spikes, said bolt being provided at the bottom with a unit that is pivotable and has a tongue designed to be in contact with one flange surface of the rail. This unit is pressed down by a spring, the other end of which is in contact with the head of the bolt so that the part in contact with the flange surface of the rail is under is pressure. This part can easily be turned aside thus permitting the rail to be very easily removed from the sole plate for the rail foot.

Further characteristics of the present invention are revealed in the appended claims.

Figure 1:
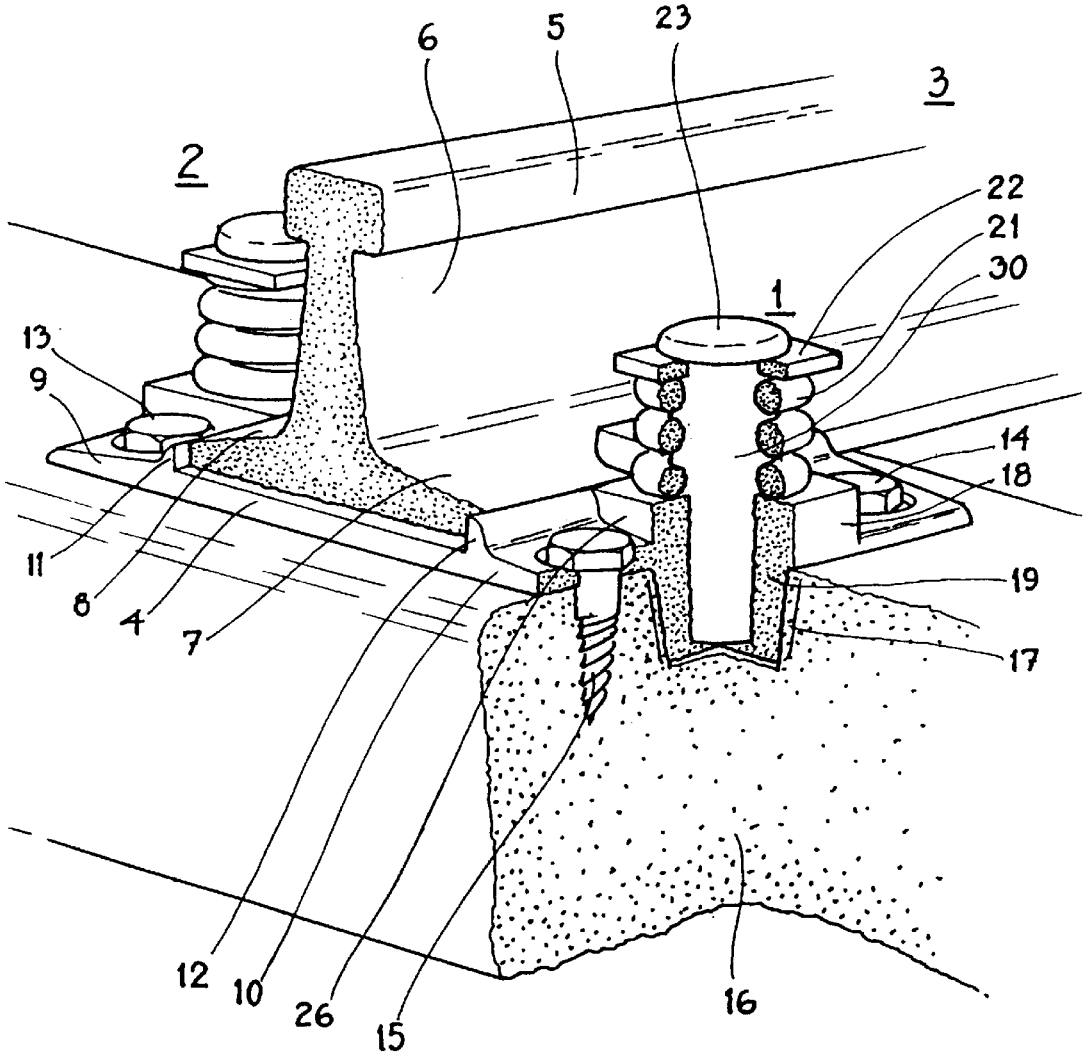
Figure 2:
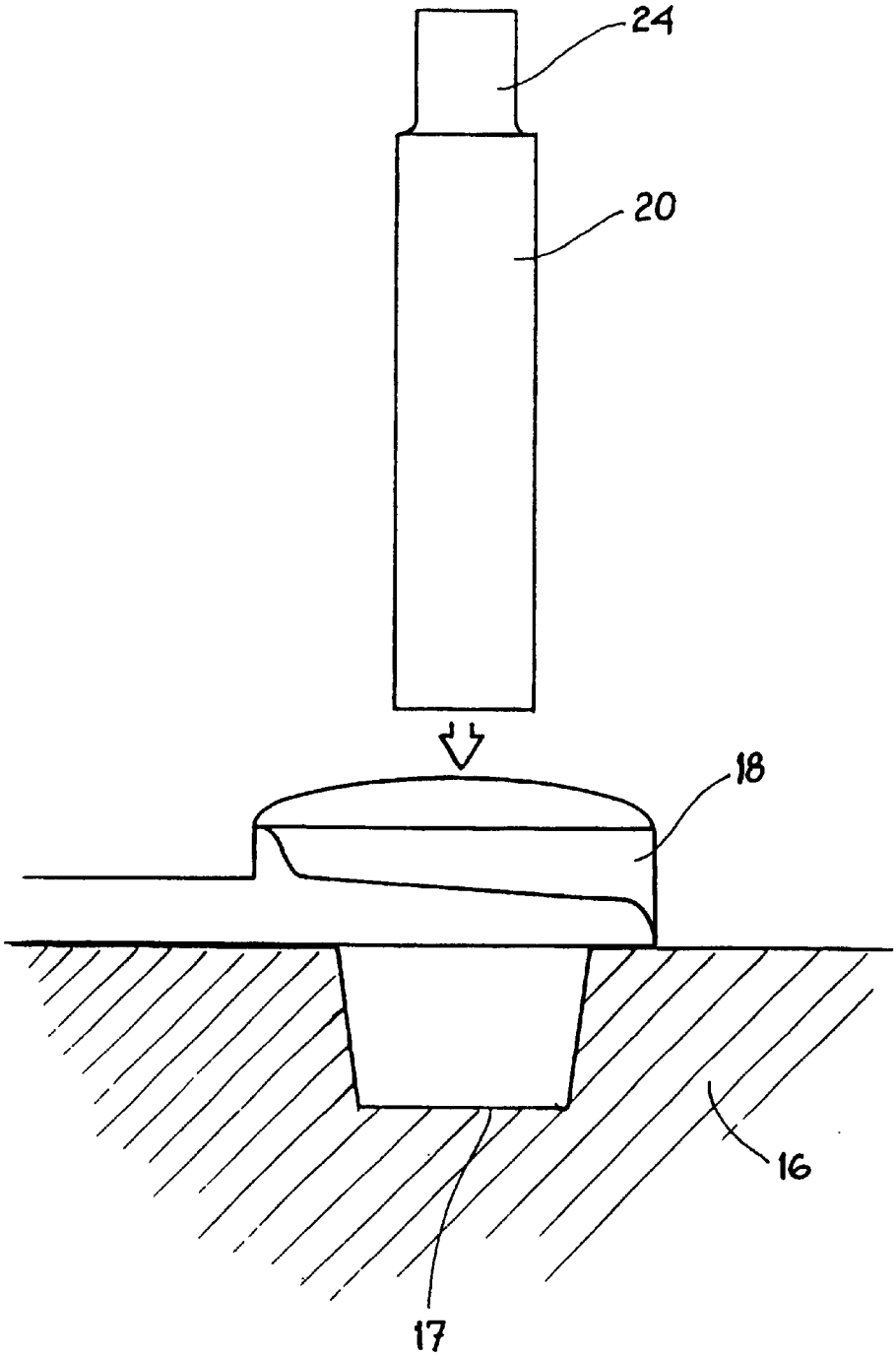
Figure 3:
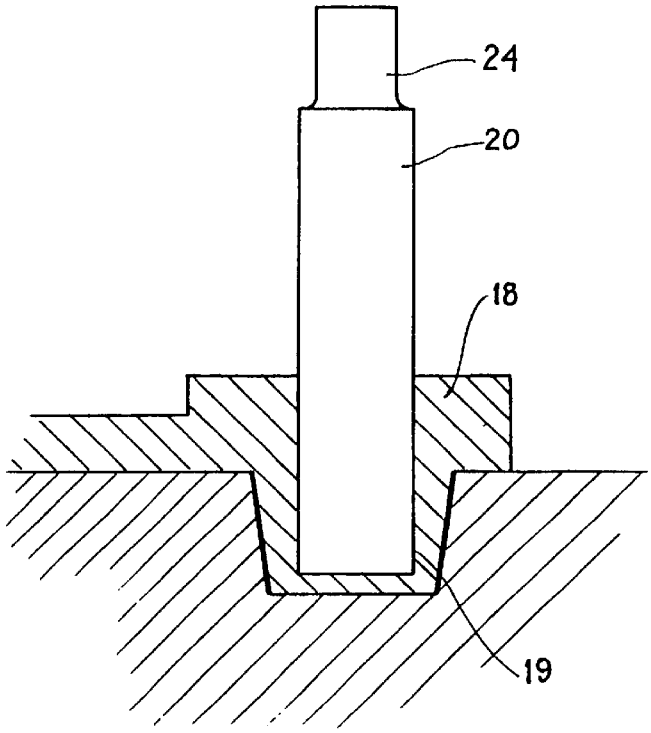
Figure 4:
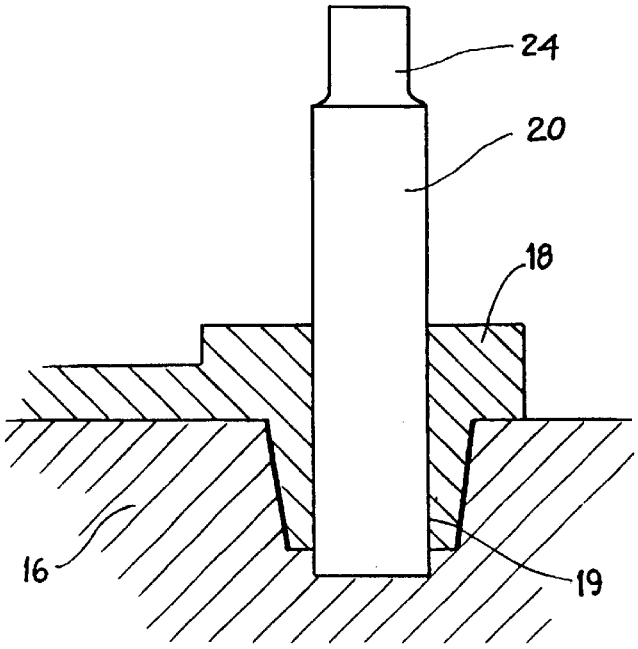

The present invention will be described in more detail with reference to the accompanying drawings describing an element included in the transport system, in which FIG. 1 shows a sleeper with rails and attachment means for the rails, FIG. 2 shows how the attachment means for the rail is formed, and FIGS. 3 and 4 show two different final phases of the bolt included in the attachment system.

A sole plate 4, with a rail 3 having a first rail foot 7 and a second rail foot 8, are applied on a sleeper 16. The rail has a waist 6 and a head 5. The sole plate 4 is provided with restricting flanges 11, 12 for the rail feet 7 and 8 thus preventing lateral movement thereof. The sole plate 4 itself is secured such as for example with screws 13, 14 and 15. Two rail attachments 1 and 2 are required to secure the rail to the sole plate 4. Each rail attachment consists of a bolt 30, a bolt head 23, a spring 21, and a unit having a radially outwardly protruding flange which can be turned or pivoted to contact a rail foot.

As is evident from FIG. 2, each sole plate is provided at its outer ends with extra material 18. The bolt 30 is pressed through this material thereby forming a tubular part 19, as is clear from FIG. 1 and FIGS. 3 and 4. The added material 18 thus forms a flat surface for contact with the radially protruding flange. The added material 18 thus forms the tubular part 19. In FIG. 3, the unit has a bottom, whereas in FIG. 4 is lacks a bottom. A spring 21 rests on the unit with the flange, and the upper end of the spring is in contact with a washer 22 which in turn abuts against the bolt head 23 formed by the part 24 in FIGS. 3 and 4. Thus, with the aid of the spring 21, the protruding flange presses with considerable force against the rail foot. The advantage of this rail attachment is that the protruding flange can be very easily turned aside, thus allowing the rail to be easily removed from the sleeper.

What is claimed is:

1. A track bound transport system comprising:

a sleeper having a pair of holes;

a rail including a pair of rail feet, each having an upper surface and an upper edge;

a sole plate including a pair of rail foot holding flanges, each having an upper edge, a pair of spike receiving portions extending from a bottom surface of the plate and into said holes, and raised portions on top of the plate; wherein, each said raised portion has a flat upper surface that is aligned with the upper edges of one of the rail feet and one of the holding flanges so as to establish a generally smooth surface transition between the upper surfaces of the raised portion and the rail foot;

at least one fastening bolt having a bolt head, and a body extending through one of the raised portions and into one of the spike receiving portions;

a coil spring having a central passageway receiving said bolt, and said coil spring being maintained under compression by said bolt head;

wherein, said raised portion, said fastening bolt, and said coil spring are adapted for cooperating with a flange, which is adapted to be forced by said coil spring to a clamping position on one of said rail feet; and said raised portion, fastening bolt and coil spring are configured to allow said flange to be selectively pivoted into and out of said clamping position smoothly along the upper surfaces of the rail foot and the raised portion.

* * * * *